US012655835B2

(12) United States Patent
Arnold

(10) Patent No.: US 12,655,835 B2
(45) Date of Patent: Jun. 16, 2026

(54) CONTROL ARRANGEMENT AND METHOD FOR CONTROLLING A SENSORLESS MEMBRANE PUMP

(71) Applicant: EPPENDORF SE, Hamburg (DE)

(72) Inventor: Matthias Arnold, Aachen (DE)

(73) Assignee: EPPENDORF SE, Hamburg (DE)

( * ) Notice: Subject to any disclaimer, the term of this patent is extended or adjusted under 35 U.S.C. 154(b) by 680 days.

(21) Appl. No.: 17/626,169

(22) PCT Filed: Jun. 12, 2020

(86) PCT No.: PCT/EP2020/066354
§ 371 (c)(1),
(2) Date: Jan. 11, 2022

(87) PCT Pub. No.: WO2021/008788
PCT Pub. Date: Jan. 21, 2021

(65) Prior Publication Data

US 2024/0209847 A1 Jun. 27, 2024

(51) Int. Cl.
*F04B 43/073* (2006.01)
*F04B 43/00* (2006.01)
*F04B 49/06* (2006.01)

(52) U.S. Cl.
CPC ..... *F04B 43/073* (2013.01); *F04B 43/0081* (2013.01); *F04B 49/065* (2013.01); *F04B 2205/09* (2013.01); *F04B 2205/18* (2013.01)

(58) Field of Classification Search
CPC ..... F04B 43/0081; F04B 43/06–073; F04B 49/22; F04B 2203/09–1001; F04B 2205/09; F04B 45/053–0536
(Continued)

(56) References Cited

U.S. PATENT DOCUMENTS 4,826,482 A * 5/1989 Kamen ..... G01F 1/34 604/246
4,976,162 A * 12/1990 Kamen ..... F04B 43/043 702/55
(Continued)

FOREIGN PATENT DOCUMENTS

CN 101693878 4/2010
CN 101886039 11/2010
(Continued)

OTHER PUBLICATIONS

Ting Yang et al, "Novel disposable flexible bioreactor for *Escherichia coli* culture in orbital shaking incubator," The Society for Biotechnology, Japan (2013), http://dx.doi.org.10.1016/j.jbiosc.2013.04.004.

*Primary Examiner* — Alexander B Comley
(74) *Attorney, Agent, or Firm* — Dinsmore & Shohl LLP

(57) ABSTRACT

A control arrangement and method for controlling a sensor-free diaphragm pump are disclosed. The control arrangement comprises a control-fluid inlet for connection to a first control-fluid reservoir having a pressure level which is elevated in relation to a reference pressure, a control-fluid outlet for connection to a second control-fluid reservoir having a pressure level which is reduced in relation to a reference pressure, a control-fluid connection for connection of a control-fluid line for the sensor-free diaphragm pump, wherein the control-fluid inlet is connected via a first proportional valve to a collecting point, and the control-fluid outlet is connected via a second proportional valve to the collecting point, wherein a mass flow sensor is arranged between the collecting point and the control-fluid connection. A control unit is in signal communication to the first proportional valve, the second proportional valve and the mass flow sensor.

18 Claims, 2 Drawing Sheets

(58) Field of Classification Search
USPC ..... 417/395
See application file for complete search history.

(56) References Cited

U.S. PATENT DOCUMENTS

| | | | | |
|---|---|---|---|---|
| 5,178,182 | A * | 1/1993 | Kamen | A61M 5/365 137/454.2 |
| 5,350,080 | A | 9/1994 | Brown et al. | |
| 5,368,801 | A | 11/1994 | Vaillancourt | |
| 5,421,208 | A * | 6/1995 | Packard | A61M 5/16886 417/384 |
| 6,202,713 | B1 | 3/2001 | Drescher et al. | |
| 6,419,462 | B1 * | 7/2002 | Horie | F04B 43/073 417/394 |
| 6,604,908 | B1 * | 8/2003 | Bryant | A61M 1/362265 417/27 |
| 7,947,032 | B2 | 5/2011 | Harding et al. | |
| 8,522,996 | B2 | 9/2013 | Beese et al. | |
| 10,871,157 | B2 * | 12/2020 | Tracey | G01M 3/188 |
| 2003/0119201 | A1 | 6/2003 | Wolfram et al. | |
| 2003/0129743 | A1 | 7/2003 | Wildi et al. | |
| 2004/0029170 | A1 | 2/2004 | Wolfram et al. | |
| 2005/0135975 | A1 | 6/2005 | Su et al. | |
| 2007/0092386 | A1 * | 4/2007 | Reed | F04B 43/0736 417/395 |
| 2008/0058697 | A1 * | 3/2008 | Kamen | A61M 1/36225 604/113 |
| 2008/0131957 | A1 | 6/2008 | Ryan et al. | |
| 2009/0202361 | A1 * | 8/2009 | Reed | F04B 43/0736 417/46 |
| 2009/0324431 | A1 * | 12/2009 | van Boeyen | F04B 45/02 417/375 |
| 2010/0040483 | A1 * | 2/2010 | Berger | G01N 30/32 417/205 |
| 2010/0291674 | A1 | 11/2010 | Beese et al. | |
| 2010/0308051 | A1 | 12/2010 | Weber | |
| 2011/0233210 | A1 | 9/2011 | Fatherazi et al. | |
| 2012/0244016 | A1 * | 9/2012 | Van De Walle | F04B 43/02 417/63 |
| 2014/0011270 | A1 | 1/2014 | Chotteau et al. | |
| 2015/0132840 | A1 | 5/2015 | Arnold et al. | |
| 2015/0218501 | A1 | 8/2015 | Kauling et al. | |
| 2015/0292529 | A1 | 10/2015 | Thiebaud et al. | |
| 2016/0108354 | A1 | 4/2016 | Kahlert et al. | |
| 2016/0208791 | A1 * | 7/2016 | Reeh | F04B 45/02 |
| 2018/0274533 | A1 * | 9/2018 | Ambrosina | A61M 5/14228 |
| 2019/0063420 | A1 * | 2/2019 | Stobbe | F04B 43/0736 |
| 2019/0192760 | A1 * | 6/2019 | Gorbachinsky | A61M 3/022 |
| 2019/0353159 | A1 * | 11/2019 | Anderle | F04B 49/22 |

FOREIGN PATENT DOCUMENTS

| | | | | |
|---|---|---|---|---|
| CN | 104379722 | | 2/2015 | |
| CN | 104508110 | | 4/2015 | |
| CN | 104884102 | | 9/2015 | |
| CN | 106489026 | | 3/2017 | |
| DE | 2137854 | | 2/1973 | |
| DE | 102004059146 | | 7/2005 | |
| DE | 202009015434 | | 4/2010 | |
| DE | 202012012626 | U1 * | 7/2013 | A61M 1/1605 |
| DE | 102016015207 | | 6/2018 | |
| DE | 102016015207 | A1 * | 6/2018 | F04B 43/0733 |
| EP | 2251407 | | 11/2010 | |
| EP | 2379889 | | 10/2011 | |
| EP | 2674479 | | 12/2013 | |
| EP | 2853584 | | 4/2015 | |
| EP | 3460036 | | 3/2019 | |
| EP | 3514223 | | 4/2019 | |
| JP | 2003293960 | | 10/2003 | |
| JP | 2003293960 | A * | 10/2003 | A61M 5/16886 |
| JP | 2007282629 | | 11/2007 | |
| JP | 2007330108 | | 12/2007 | |
| JP | 2010226975 | | 10/2010 | |
| JP | 2010263891 | | 11/2010 | |
| JP | 4986659 | | 7/2012 | |
| JP | 2013502930 | | 1/2013 | |
| JP | 2014528250 | | 10/2014 | |
| JP | 2017006696 | | 1/2017 | |
| JP | 2017006696 | A * | 1/2017 | A61M 1/369 |
| WO | WO-9013795 | A2 * | 11/1990 | F04B 43/043 |
| WO | 9532014 | | 11/1995 | |
| WO | WO-9532014 | A1 * | 11/1995 | G01F 1/86 |
| WO | 9902961 | | 1/1999 | |
| WO | 2006044441 | | 4/2006 | |
| WO | 2007120812 | | 10/2007 | |
| WO | 2008016411 | | 2/2008 | |
| WO | 2010069321 | | 6/2010 | |
| WO | 2011025890 | | 3/2011 | |
| WO | 2011126793 | | 10/2011 | |
| WO | 2011144561 | | 11/2011 | |
| WO | 2013053778 | | 4/2013 | |
| WO | 2013053779 | | 4/2013 | |
| WO | 2013150064 | | 10/2013 | |
| WO | 2013158756 | | 10/2013 | |
| WO | 2013186294 | | 12/2013 | |
| WO | 2014042827 | | 3/2014 | |
| WO | 2014177240 | | 11/2014 | |
| WO | 2015077663 | | 5/2015 | |
| WO | 2015135376 | | 9/2015 | |
| WO | 2016066768 | | 5/2016 | |
| WO | 2017129800 | | 8/2017 | |
| WO | 2018115028 | | 6/2018 | |
| WO | WO-2018115028 | A1 * | 6/2018 | A61M 60/837 |
| WO | 2021008788 | | 1/2021 | |

* cited by examiner

CONTROL ARRANGEMENT AND METHOD FOR CONTROLLING A SENSORLESS MEMBRANE PUMP

The present application claims the benefit under 35 U.S.C. §§ 119(b), 119(e), 120, and/or 365(c) of PCT/EP2020/066354 filed Jun. 12, 2020, which claims priority to Application No. LU101302 filed Jul. 12, 2019.

FIELD OF THE INVENTION

The invention relates to a control arrangement for controlling a sensor-free diaphragm pump. The invention furthermore relates to a method for controlling a sensor-free diaphragm pump. The invention furthermore relates to a diaphragm pump arrangement having a diaphragm pump, and having a control arrangement for controlling the diaphragm pump. The invention furthermore relates to a diaphragm pump and to a bioreactor having a diaphragm pump arrangement or having a diaphragm pump, and to the use of a diaphragm pump arrangement with a bioreactor or with a diaphragm pump in a bioreactor.

BACKGROUND OF THE INVENTION

In the area of bioprocess technology, in particular, where use is made of bioreactors, diaphragm pumps are used to convey media. Media to be conveyed in bioprocess technology are in particular fluids which may contain, for example, biological cells and/or other constituents that may be the subject of studies or a further use. A diaphragm pump and the use thereof in bioreactors is described for example in EP 2 379 889 B1.

There is, however, a need for improved solutions, in particular, for a control arrangement and a method for controlling a diaphragm pump and also for a diaphragm pump, which improve process reliability and/or constitute a particularly inexpensive solution.

This object is achieved by a control arrangement for controlling a sensor-free diaphragm pump that comprises a control-fluid inlet for connection to a first control-fluid reservoir having a pressure level which is elevated in relation to a reference pressure, a control-fluid outlet for connection to a second control-fluid reservoir having a pressure level which is reduced in relation to a reference pressure, a control-fluid connection for connection of a control-fluid line for the sensor-free diaphragm pump, wherein the control-fluid inlet is connected via a first proportional valve to a collecting point, and the control-fluid outlet is connected via a second proportional valve to the collecting point, wherein a mass flow sensor is arranged between the collecting point and the control-fluid connection, and wherein the control arrangement furthermore comprises a control unit which is connected in terms of signaling to the first proportional valve, the second proportional valve and the mass flow sensor.

The invention is based inter alia on the realization that existing diaphragm pumps and control arrangements and also methods are dependent on a distance sensor for determining the position of the diaphragm. Not only does this lead to an increase in the cost of the diaphragm pump itself, but also this solution entails inaccuracies since the displaced volume is determined, by means of the distance sensor, only indirectly and the spatial deformation of the elastic diaphragm cannot be described in a reproducible manner. Moreover, high loading of the media constituents often occurs during the actuation of the diaphragm and the conveyance of the medium to be conveyed. For example, there can occur large shear forces which can damage, in particular, biological cells in the medium to be conveyed, which can adversely affect, or even render impossible, the study and/or further processing thereof. Specifically in fields where use is made of inexpensive disposable bioreactors, expensive diaphragm pumps with distance sensors are moreover unattractive.

The control arrangement described herein, by contract, makes it possible to dispense with a distance sensor for determining the position of the diaphragm of the diaphragm pump and at the same time to ensure accurate and gentle conveyance of the medium to be conveyed. In this way, firstly the use of sensor-free and thus significantly less expensive diaphragm pumps—also in the form of disposable diaphragm pumps in disposable bioreactors—is made possible. At the same time, it is ensured that the medium, and the constituents thereof, conveyed by way of the diaphragm pump are volumetrically conveyed precisely and in such a gentle manner that the process reliability is increased and further study and further processing are improved.

This is realized by the described control arrangement for controlling a sensor-free diaphragm pump. For controlling a diaphragm pump, the control arrangement described herein is no longer dependent on signals of a distance sensor for detecting the position of the diaphragm of the diaphragm pump.

A sensor-free diaphragm pump is to be understood here as being, in particular, a diaphragm pump which has no distance sensor for detecting the position of the diaphragm. Preferably, a sensor-free diaphragm pump also contains no further sensors.

Such configurations of a diaphragm pump have the advantage that the costs for a distance sensor for detecting the position of the diaphragm, and possibly for further sensors, can be saved, and the diaphragm pump can be produced in a significantly less expensive manner and is thus also available for disposable applications.

SUMMARY OF THE INVENTION

The control arrangement described herein is designed in such a way that it can control such a sensor-free diaphragm pump. For this purpose, the control arrangement comprises the elements described in the following text.

A control-fluid inlet and a control-fluid outlet serve for connection of the control arrangement to a first and second control-fluid reservoir, wherein the control-fluid inlet is connected to a first control-fluid reservoir having a pressure level which is elevated in relation to a reference pressure, and the control-fluid outlet is connected to a second control-fluid reservoir having a pressure level which is reduced in relation to a reference pressure.

Via a control-fluid connection, the control arrangement can be connected by means of a control-fluid line to a sensor-free diaphragm pump. In this way, control fluid can pass, from the first control-fluid reservoir, from the control-fluid inlet to the control-fluid connection and, from there, via the control-fluid line into the control fluid-side chamber of the sensor-free diaphragm pump and, from there, via the control-fluid line back into the second control-fluid reservoir via the control-fluid outlet.

The first and the second control-fluid reservoirs may also be part of an entire control-fluid reservoir which provides the pressure levels elevated or reduced in relation to a reference pressure that are required for conveyance of the control fluid into and out of the control fluid-side chamber of the diaphragm pump via the control arrangement.

Both the control-fluid inlet and the control-fluid outlet are connected to a collecting point which, in turn, is connected to the control-fluid connection. A first proportional valve is situated between the control-fluid inlet and the collecting point, and a second proportional valve is situated between the control-fluid outlet and the collecting point. Via said proportional valves, the control arrangement can control the control-fluid flow from the control-fluid inlet to the control-fluid connection and from the control-fluid connection to the control-fluid outlet. For this purpose, the control arrangement has a control unit which is connected in terms of signaling to the first proportional valve and to the second proportional valve.

The control arrangement furthermore has a mass flow sensor which is arranged between the collecting point and the control-fluid connection. The mass flow sensor is preferably in the form of a thermal mass flow sensor. Via the mass flow sensor, the mass flow rate of the control fluid can be determined between the collecting point and the control-fluid connection. For this purpose, the control unit of the control arrangement is likewise connected in terms of signaling to the mass flow sensor. In this way, it is possible for use to be made of signals of the mass flow sensor during the actuation of the first and/or second proportional valve.

The control-fluid inlet is preferably connected to the collecting point via a control-fluid line, and the control-fluid outlet is likewise preferably connected to the collecting point via a control-fluid line. Also, the collecting point is preferably connected to the control-fluid connection via a control-fluid line. A control-fluid line which connects the control arrangement to the sensor-free diaphragm pump may furthermore be connected to the control-fluid connection. It is also preferably possible, in each case, for one control-fluid line to be connected to the control-fluid inlet and/or to the control-fluid outlet in order to connect the control-fluid inlet and/or the control-fluid outlet to the first and/or the second control-fluid reservoir.

The sensor-free diaphragm pump has a control fluid-side chamber and a media-side chamber. The control fluid is fed to or discharged from the control fluid-side chamber by the control arrangement via a control-fluid line. The media-side chamber is flowed through by the medium to be conveyed. An elastic diaphragm fluidically separates the two chambers from one another, but volumetrically couples said chambers. The media-side chamber has one or more media connections, via which the medium to be conveyed flows into and out of the media-side chamber. For controlling the media flow, the connections may preferably be provided with a valve, for example, with an automatically acting valve or with a controlled valve, in particular, with a check valve.

In a preferred embodiment, the media-side chamber of the sensor-free diaphragm pump has exactly one media inlet for the inflow of the medium and exactly one media outlet for the outflow of the medium. Preferably, the media inlet and the media outlet each have a check valve, in particular, an automatically acting check valve, which is arranged according to the flow direction through the respective media inlet or media outlet.

A bioreactor is to be understood here as being, in particular, a flexible or dimensionally stable container which forms in its interior a reaction chamber in which a bioprocess may take place. For this purpose, a media mixture, which may also be referred to as culture broth, is generally situated in the bioreactor. Bioreactors commonly have one or more connections via which media can be fed or discharged, samples can be extracted, or sensors for different measurements can be connected. Diaphragm pumps are used in bioreactors, for example, in order to allow media or media samples to be extracted or fed or in order for media to be moved and, in this way, for example, to be mixed.

Bioreactors generally have to be provided in a sterile state for bioprocesses. Since the sterilization of bioreactors already used is laborious and expensive and always presents a process risk too, use is increasingly being made of disposable bioreactors, which are provided for one-time use only and, after being used, are disposed of. For this purpose, there is firstly a need for inexpensive designs and inexpensive materials, and at the same time as far as possible resource-conserving and environmentally compatible materials, which however at the same time meet the requirements for bioprocess technology, for example, of United States Pharmacopeia (USP) Class VI. In this context, disposable diaphragm pumps which can form a part of a disposable bioreactor and, after being used, can likewise be disposed of, possibly together with the disposable bioreactor, are also preferred. For this purpose, too, inexpensive, resource-conserving, and environmentally compatible materials which at the same time meet the high requirements for bioprocess safety are preferred.

The volumetric flow rate of the control fluid can be determined via the mass flow rate, detected by the mass flow sensor, of the control fluid, which correlates with the molar quantity flow rate. The molar particle number and the corresponding conveyed volume of the control fluid can be determined by integration over time. In this way, a volumetric actuation of the sensor-free diaphragm pump is made possible by the control arrangement described herein.

The connection in terms of signaling of the mass flow sensor, on the one hand, and of the first and second proportional valves, on the other hand, to the control unit of the control arrangement furthermore makes it possible for the control-fluid flow from the control-fluid inlet to the control-fluid connection and back to the control-fluid outlet to be controlled according to the data detected by the mass flow sensor and, in this way, for the absence of a distance sensor for detecting the position of the diaphragm to be compensated.

The control arrangement described herein makes it possible, by way of its structure and the provision of the mass flow sensor between the collecting point and the control-fluid connection, for all the elements required for the control of the sensor-free diaphragm pump to be combined in the control arrangement. Thus, only simple connections to the control-fluid reservoirs, on the one hand, and to the sensor-free diaphragm pump, on the other hand, are necessary. Furthermore, in this way, all the control-relevant sensors and other components are combined in the control arrangement. Consequently, the—preferably reusable—control arrangement can contain all the complex and possibly expensive components and can be arranged separated, possibly also spatially at a distance, from, for example, a disposable bioreactor having a sensor-free disposable diaphragm pump used therein.

Preferably, the control arrangement is configured to control more than one sensor-free diaphragm pump. For this purpose, for example, multiple control-fluid lines or a branching control-fluid line to multiple sensor-free diaphragm pumps may be connected to the control-fluid connection. In this case, the multiple sensor-free diaphragm pumps would preferably all be actuated in an identical manner. This is suitable, in particular, for parallel bioprocesses which take place in parallel in a multiplicity of identically constructed arrangements.

The control arrangement may also preferably be configured to actuate multiple diaphragm pumps differently. For this purpose, it is preferable, in each case, for the required components to be accordingly provided multiply in the control arrangement. In this way, the corresponding components may, in a common control arrangement, be combined, and made available centrally, also for the actuation of multiple diaphragm pumps, also for different applications with different actuations.

The control arrangement may also, in particular. if it is configured to actuate multiple diaphragm pumps with different types of actuation, be configured in a distributed, for example, even spatially spaced-apart, manner and, by way of corresponding connections (for example, in terms of signaling and/or fluidically and/or in a line-dependent manner and/or in a line-independent manner), form a coherent control arrangement.

It is particularly preferable that the mass flow sensor is configured for a measurement in both flow directions. Consequently, the mass flow sensor is preferably configured to detect the mass flow rate of the control fluid between the collecting point and the control-fluid connection independently of the flow direction of the control fluid, that is to say, independently of whether the control fluid flows from the control-fluid inlet to the control-fluid connection or flows from the control-fluid connection to the control-fluid outlet.

In a preferred embodiment, it is provided that a pressure sensor, in particular, an absolute pressure sensor, is arranged between the collecting point and the control-fluid connection. In particular, it is preferable for the pressure sensor to be arranged between the mass flow sensor and the control-fluid connection. Here, it is furthermore preferable for the control unit to be connected in terms of signaling to the pressure sensor.

The provision of a pressure sensor, and, in particular, its connection in terms of signaling to the control unit, has the advantage that the control-fluid pressure can also be taken into account during the actuation of the sensor-free diaphragm pump.

Via the volumetric coupling of the control-fluid side chamber and the media-side chamber of the sensor-free diaphragm pump, not only is the volumetric flow rate, and accordingly the conveyed volume of the medium to be conveyed, correlated with the control fluid, but also the pressure of the medium to be conveyed is correlated with the pressure of the control fluid. Since the medium to be conveyed, in particular, its constituents, such as, for example, biological cells, are often sensitive to pressure and/or can be adversely affected, or even destroyed, by shear forces, it is advantageous if, during the actuation, the pressure can be taken into account too, and, in particular, for example, limit values, pressure ranges and/or pressure gradients, in particular, temporal gradients, to be predefined and to be complied with during the control in order to achieve a particularly gentle conveyance by way of the sensor-free diaphragm pump of the medium to be conveyed.

Furthermore, through the inclusion of the control-fluid pressure, the accuracy of the actuation of the sensor-free diaphragm pump can be further improved.

In a further embodiment, the control arrangement furthermore comprises a temperature sensor and/or a temperature-sensor interface for signal exchange with a temperature sensor, in particular, for receiving signals from a temperature sensor. In this case, the control unit is preferably connected in terms of signaling to the temperature sensor and/or to the temperature-sensor interface.

The temperature sensor may be configured, for example, to detect the ambient temperature. Furthermore, the temperature sensor may be configured, for example, to detect the temperature of the medium to be conveyed, for example, in a bioreactor.

The detection of the temperature or the use of a signal of a temperature sensor contributes to further improvement of the actuation. The account taken of the temperature in the determination of volumetric flow rate and volume from the detected mass flow rate makes it possible, in particular, to further improve the accuracy of the actuation.

Furthermore, in a further preferred embodiment, it is provided that the control unit has a communication interface for exchange with an external communication unit. In particular, it is preferable for the communication interface to comprise or to be a data interface for exchange of data.

Via the communication interface, it is possible, for example, for preferred control algorithms, limit values, ranges, or gradients, for example, for the pressure to be complied with, flow speeds, mass, or volumetric flow rates or volumes to be transmitted and thus predefined, and/or for evaluations and/or values generated during the control to be transferred to an external communication unit and further processed there.

In particular, it is preferable for the control unit to be configured to actuate a first proportional valve of a control arrangement for enabling throughflow and to convey a control fluid, to close the first proportional valve when a volume to be conveyed has been reached, to actuate the second proportional valve for enabling throughflow and to convey the control fluid, and to close the second proportional valve when the volume to be conveyed has been reached.

It is furthermore preferable for the control unit to be configured to determine the conveyed volume of the control fluid, wherein determining the conveyed volume of the control fluid preferably comprises: receiving a mass flow rate signal from the mass flow sensor, deducing a volumetric flow rate from the mass flow rate signal, and deducing a volume of the conveyed control fluid from the volumetric flow rate.

It is furthermore preferable for the control unit to be configured to determine end positions of the diaphragm of the sensor-free diaphragm pump, wherein determining end positions of the diaphragm of the sensor-free diaphragm pump preferably comprises: actuating the first and/or second proportional valve so as to convey control fluid at a predefined initialization volumetric flow rate, receiving a pressure-gradient signal, and establishing a presence of an end position of the diaphragm when the pressure-gradient signal changes.

According to a further aspect of the invention, the object stated in the introduction is achieved by a diaphragm pump arrangement having a diaphragm pump, in particular, a sensor-free diaphragm pump, and having an above-described control arrangement.

According to a further aspect, the object stated in the introduction is achieved by a diaphragm pump for use with an above-described control arrangement characterized in that the diaphragm pump is free of a distance sensor for detecting the position of the diaphragm.

According to a further aspect, the object stated in the introduction is achieved by a bioreactor having an above-described diaphragm pump arrangement or having an above-described diaphragm pump.

According to a further aspect, the object stated in the introduction is achieved by the use of an above-described diaphragm pump arrangement with a bioreactor or with an above-described diaphragm pump in a bioreactor.

According to a further aspect, the object stated in the introduction is achieved by a method for controlling a sensor-free diaphragm pump, the method comprising: actuating a first proportional valve of a control arrangement for enabling throughflow, and conveying a control fluid, closing the first proportional valve when a volume to be conveyed has been reached, actuating the second proportional valve for enabling throughflow, and conveying the control fluid, and closing the second proportional valve when the volume to be conveyed has been reached.

The method described herein makes possible a volumetric control of a sensor-free diaphragm pump. For this purpose, by way of corresponding actuation of a first proportional valve, firstly the control fluid is conveyed from the first control-fluid reservoir to the control-fluid connection, preferably at a predetermined mass flow rate and/or a predetermined volumetric flow rate. As soon as a volume to be conveyed has been reached, the first proportional valve is closed. For this purpose, it is preferably the case that the conveyed volume of the control fluid is determined and compared with the desired volume to be conveyed. After the volume to be conveyed has been reached and the first proportional valve has been closed, the second proportional valve is actuated for enabling throughflow and the control fluid is conveyed, preferably at a predetermined mass flow rate and/or at a predetermined volumetric flow rate, from the control-fluid connection to the second control-fluid reservoir. After the volume to be conveyed has been reached, the second proportional valve is closed. Here, too, it is preferably the case that the conveyed volume of the control fluid is determined and compared with the desired volume to be conveyed.

The conveyance of the control fluid by way of the first proportional valve and the conveyance of the control fluid by way of the second proportional valve are realized in different flow directions, toward the diaphragm pump in the first case and away from the diaphragm pump toward the second control-fluid reservoir in the second case.

Determining the conveyed volume of the control fluid preferably comprises detecting a mass flow rate of the control fluid, deducing a volumetric flow rate from the mass flow rate, and deducing a volume of the conveyed control fluid from the volumetric flow rate.

The detection of the mass flow rate of the control fluid is preferably realized by the mass flow sensor of the control arrangement before the control fluid exits the control-fluid connection in the direction of the sensor-free diaphragm pump. For the deduction of a volumetric flow rate from the mass flow rate, depending on the boundary conditions, approximately isothermal processes may be assumed in the case of low speeds and differential pressures or adiabatic processes may be assumed in the case of relatively rapid changes.

The volumetric flow rate F of a gaseous control fluid can be determined, for example, on the basis of the ideal gas law, or on the basis of a function-based relationship individually matched to the gaseous fluid used. Here, account is preferably taken of the molar quantity flow rate n, and possibly a detected pressure p and/or a detected temperature T and the universal gas constant R. For example, the following formula may be taken as a basis here: $F=(n*R*T)/p$.

For deducing the volume of the conveyed control fluid, preferably the mass flow rate, which correlates with the molar quantity flow rate, is used to determine, by integration over time, the molar particle number, from which it is then possible, with the aid of the ideal gas law or a function-based relationship individually matched to the gaseous fluid and possibly with further parameters, such as, for example, pressure and/or temperature, taken into account, to determine the volume of the control fluid which has been conveyed through the control-fluid connection.

From this, it is in turn preferably possible to deduce the volume conveyed into the control fluid-side chamber of the diaphragm pump. Here, account is preferably taken of a dead volume extending between a control-fluid entry of the control fluid-side chamber of the sensor-free diaphragm and the proportional valves of the control arrangement and comprising all the volumes of the interposed components which guide the control fluid.

According to a preferred development, the method furthermore comprises detecting a pressure of the control fluid, and actuating the first and/or the second proportional valve in such a way that a predefined target pressure of the control fluid is not exceeded and/or a predefined target-pressure range is complied with and/or a predefined pressure gradient is complied with.

The pressure of the control fluid is preferably determined by a pressure sensor of the control arrangement, in particular, still within the control arrangement before the control fluid exits the control-fluid connection in the direction of the sensor-free diaphragm pump. The actuation of the sensor-free diaphragm pump is preferably realized in such a way that predefined pressure parameters are complied with. In particular a pressure gradient, in particular, concerning a change in pressure over time, is to be complied with here, in order to allow a conveyance of the medium that is as gentle as possible for cells.

A further preferred development of the method comprises determining end positions of the diaphragm of the sensor-free diaphragm pump. Here, it is preferably the case that the volumetric end positions of the diaphragm of the sensor-free diaphragm pump are detected. Said volumetric end positions of the diaphragm correspond, in particular, to a maximum and minimum filling volume of the control fluid-side chamber, and to a maximum and minimum filling volume of the media-side chamber, of the sensor-free diaphragm pump.

Determining the end positions of the diaphragm of the sensor-free diaphragm pump preferably comprises conveying control fluid at a predefined initialization volumetric flow rate, detecting the pressure gradient of the control fluid, and establishing a presence of an end position of the diaphragm when the pressure gradient changes.

Here, it is preferably the case that control fluid is conveyed, in particular, at a predefined initialization volumetric flow rate, and in parallel the pressure gradient of the control fluid is detected, until it is established that the pressure gradient is changing, in particular, rising, significantly. From this, it can be inferred that the diaphragm has reached one of its end positions. Through conveyance of the control fluid in the opposite direction, preferably likewise at a predefined initialization volumetric flow rate, and again parallel detection of the pressure gradient of the control fluid, it is again possible to infer the presence of the second end position of the diaphragm from a significant change in the pressure gradient. The total differential volume of the sensor-free diaphragm pump can be deduced from the volume conveyed between said two end positions. Accordingly, diaphragm reference points situated between the two end positions and associated conveyance volumes can be determined. The neutral position of the diaphragm, for example, corresponds to half the total differential volume.

The method described herein and the developments thereof have features or method steps which make them suitable, in particular, for being used with a control arrangement described herein and the developments thereof.

The control arrangement described herein and the developments thereof have features which make them suitable, in particular, for being used with a method described herein and the developments thereof or are designed accordingly for this purpose.

With regard to the advantages, embodiment variants, and embodiment details of the aspects described herein and the respective developments thereof, reference is also made to the description pertaining to the corresponding features and advantages of the in each case other aspects.

BRIEF DESCRIPTION OF THE DRAWINGS

Preferred exemplary embodiments will be described by way of example on the basis of the appended figures. In the figures.

DETAILED DESCRIPTION OF THE EMBODIMENTS

Figure 1:
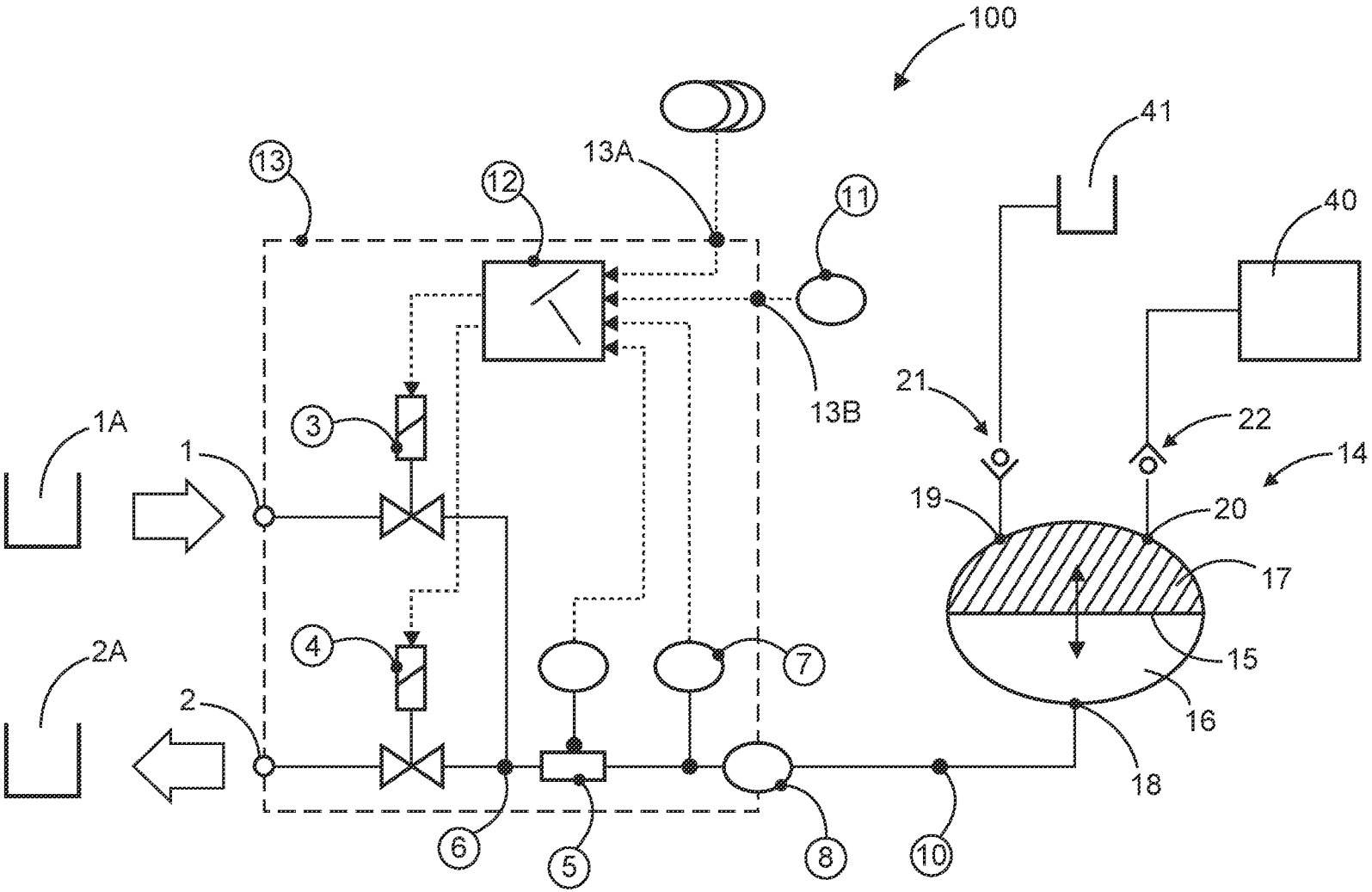
FIG. 1 shows a schematic illustration of a diaphragm pump arrangement having a control arrangement and having a sensor-free diaphragm pump.
Figure 2:
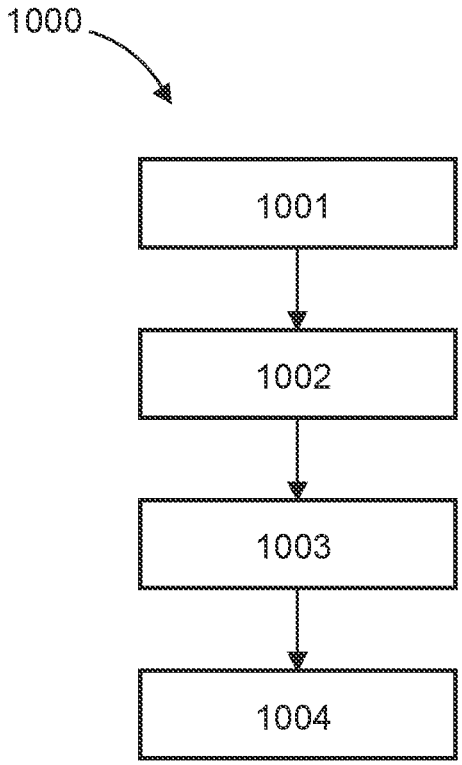
FIG. 2 shows a schematic flow diagram of a method for controlling a sensor-free diaphragm pump.

FIG. 1 shows a schematic illustration of a diaphragm pump arrangement 100 having a control arrangement 13 and having a sensor-free diaphragm pump 14, and FIG. 2 shows a schematic flow diagram of a method 1000 for controlling a sensor-free diaphragm pump 14.

In the Figures, identical or substantially functionally identical elements are denoted by the same reference signs. General descriptions relate as a rule to all the embodiments, unless differences are explicitly indicated.

FIG. 1 illustrates a diaphragm pump arrangement 100 having a sensor-free diaphragm pump 14 and having a control arrangement 13. Beside the diaphragm pump arrangement 100, a first and a second control fluid reservoir 1A, 2A, a bioreactor 40, and a sample container 41 are illustrated.

The sensor-free diaphragm pump 14 has an elastic diaphragm 15 which fluidically separates a control fluid-side chamber 16 from a media-side chamber 17, but volumetrically couples said chambers. Via a control-fluid entry 18 of the diaphragm pump 14, control fluid provided by the control arrangement 13 via the control-fluid line 10, can flow into the control-fluid side chamber 16 of the diaphragm pump 14 and can flow out of it. The media-side chamber 17 of the diaphragm pump 14 has a media inlet 20, which has an automatically acting check valve 22, and a media outlet 19, which likewise has an automatically acting check valve 21. Via said media inlet and media outlet 20, 19, medium to be conveyed can be guided from a bioreactor 40 to the diaphragm pump 14 and from the diaphragm pump 14, for example, to a sample container 41.

The sensor-free diaphragm pump 14 has no distance sensor for determining the position of the diaphragm 15. The sensor-free diaphragm pump 14 preferably also has no further sensors. This has the advantage that the sensor-free diaphragm pump 14 can be produced inexpensively and can thus be used also as a disposable diaphragm pump, in particular, together with a disposable bioreactor.

The control fluid required for the operation of the diaphragm pump 14 is provided via the control-fluid reservoirs 1A, 2A. The first control-fluid reservoir 1A has a pressure level which is elevated in relation to a reference pressure, for example, in the range of 200 to 10 000 hPa as a compressed-air supply. The second control-fluid reservoir has a pressure level which is reduced in relation to a reference pressure, for example, in the range of −200 to −900 hPa in the form of a vacuum system.

The control arrangement 13, whose system boundaries are illustrated by the broken line, preferably contains all the components required for the, in particular, volumetric actuation of the sensor-free diaphragm pump 14. In this way, the control intelligence contained in the control arrangement and the components required for this purpose may be arranged separated from the sensor-free diaphragm pump, in particular, also spatially separated therefrom, so that, for example, the sensor arrangement 13 may be designed to be re-usable and the sensor-free diaphragm pump 14 may be designed as a disposable component.

The control arrangement 13 has a control-fluid inlet 1 for connection to the first control-fluid reservoir 1A and has a control-fluid outlet 2 for connection to the second control-fluid reservoir 2A. The control-fluid inlet 1 and the control-fluid outlet 2 are connected via control-fluid lines to the collecting point 6. The collecting point 6, in turn, is connected via a control-fluid line to the control-fluid connection 8. Via the control-fluid inlet 8, the control arrangement 13 can be connected via a control-fluid line 10 to a control-fluid entry 18 of the diaphragm pump 14.

The control-fluid inlet 1 is connected via a first proportional valve 3 to the collecting point 6, and the control-fluid outlet 2 is connected via a second proportional valve 4 to the collecting point 6. The proportional valves 3, 4 are connected in terms of signaling to a control unit 12.

A thermal mass flow sensor 5 and an absolute pressure sensor 7 are arranged between the collecting point 6 and the control-fluid connection 8. The mass flow sensor 5 and the pressure sensor 7, too, are connected in terms of signaling to the control unit 12. Furthermore, provision is made of a temperature sensor 11 which measures the ambient temperature and which, via a temperature-sensor interface 13B, is likewise connected in terms of signaling to the control unit 12. The control arrangement 13 furthermore has a communication interface 13A which is configured for exchange, in particular, of data, with an external communication unit. The communication interface 13A is preferably configured as a digital interface.

From the control-fluid inlet 1, control fluid is conveyed via the first proportional valve 3 from the first control-fluid reservoir 1A to the collecting point 6 and, from there, via the control-fluid connection 8 to the diaphragm pump 14 in order, there, for the control fluid-side chamber 16 to be filled and, in this way, for medium situated in the media-side chamber 17 of the diaphragm pump 14 to be displaced through the media outlet 19 of the diaphragm pump 14 and, for example, delivered into a sample container 41.

Via the control-fluid entry 18, control fluid is extracted from the control fluid-side chamber 16 of the diaphragm pump 14 from the control-fluid connection 8 and, via the collecting point 6 and the second proportional valve 4, is drawn from the control-fluid outlet 2 into the second control-fluid reservoir 2A.

Control fluid thus flows between the collecting point 6 and the control-fluid connection 8 in different flow directions, according to conveying direction, within the control arrangement 13. The mass flow sensor 5 is, therefore, preferably configured to detect the mass flow rate of the control fluid independently of its flow direction or to perform a detection of the mass flow rate both for a flow direction from the collecting point 6 to the control-fluid connection 8 and for a flow direction from the control-fluid connection 8 to the collecting point 6. Preferably, the pressure sensor 7 is likewise configured to detect the pressure of the control fluid independently of its flow direction.

The mass flow sensor 5 is preferably in the form of a thermal mass flow sensor for gaseous media, the measurement signal of which correlates with the molar quantity flow rate of the gas.

The sensor-free diaphragm pump 14 can be actuated by means of the control arrangement 13 in order for the medium to be conveyed in the media-side chamber 17 of the diaphragm pump to be moved from the media inlet 20 to the media outlet 19 in that the diaphragm 15 is moved, in a manner controlled volumetrically by the control arrangement 13, by way of control fluid flowing in and flowing out via the control fluid line 10.

In particular, the control unit 12 of the control arrangement 13 is preferably configured to carry out the method 1000 illustrated in FIG. 2 for controlling the sensor-free diaphragm pump 14.

In the method 1000 for controlling the sensor-free diaphragm pump 14, firstly, in step 1001, the first proportional valve 3 is actuated for enabling throughflow and control fluid is conveyed in the direction of the diaphragm pump 14. In a step 1002, the first proportional valve 3 is closed as soon as a volume to be conveyed has been reached. Subsequently, in step 1003, the second proportional valve 4 is actuated for enabling throughflow and control fluid is conveyed from the diaphragm pump 14 to the second control-fluid reservoir 2A until finally, in step 1004, the second proportional valve 4 is closed as soon as the volume to be conveyed has been reached.

In order to establish that the volume to be conveyed has been reached, preferably the actually conveyed volume of the control fluid is determined. This is preferably realized as presented below. The mass flow sensor 5 is used to determine the mass flow rate, which correlates with the molar quantity flow rate. In the case of a liquid control fluid, this can correlate directly with the volumetric flow rate. In the preferred case of a gaseous control fluid with defined properties, for example, compressed air, the output signal of the thermal mass flow sensor 5 preferably correlates with the molar quantity flow rate of the control fluid. From this, the volumetric flow rate can be deduced or calculated. Here, the respective conditions, in particular, the respective properties of the control fluid, and boundary parameters are to be taken into account. For example, the volumetric flow rate of the control fluid can be calculated on the basis of the ideal gas law, or on the basis of a function-based relationship matched to the gaseous control fluid used, in that the molar quantity flow rate determined by the mass flow sensor 5, the absolute pressure p measured by the pressure sensor 7, and the temperature detected by the temperature sensor 11 and also the universal gas constant are taken into account. In the case of low speeds and differential pressures, an approximately isothermal process, or also an adiabatic process, may be taken as a basis here.

From the molar quantity flow rate n determined by the mass flow sensor 5, it is possible to firstly determine, by integration over time, the molar particle number N. Preferably, in a next step, this can be used to calculate, with the aid of the ideal gas law, with the parameters measured by the pressure sensor 7 and the temperature sensor 11 taken into account, the present volume V in the control fluid-side chamber 16 of the diaphragm pump 14 and thus also the corresponding displaced volume of the medium to be conveyed. The volume V determined in this way is thus in direct correlation with the volumetric movement of the medium to be conveyed.

Preferably, the method for controlling the sensor-free diaphragm pump 14 also comprises detecting a pressure of the control fluid and actuating the first and/or the second proportional valve 3, 4 in such a way that a predefined target pressure of the control fluid is not exceeded and/or a predefined target-pressure range is complied with and/or a predefined pressure gradient is complied with.

A volume difference between a first position of the diaphragm 15, with a correlating volume of the control fluid-side chamber 16, and a second position of the diaphragm, with a second correlating volume of the control fluid-side chamber 16, may also be referred to as differential volume dV. If the first and second positions of the diaphragm are the end positions thereof, the result is the total differential volume. The initialization with a defined initial value of the integrator for calculating the number of particles to be taken into account altogether will be described further below.

Here, a volumetric control with defined volumetric flow rate may proceed, for example, as follows. A volume dV to be conveyed of the medium to be conveyed is to be conveyed at a predetermined volumetric flow rate. For this purpose, control fluid is, in a regulated manner, made to flow into the control fluid-side 16 of the diaphragm pump 14 from the control-fluid reservoir 1A, wherein the first proportional valve 3 is actuated by the control unit 12, as described above for determining the volumetric flow rate and the volume to be conveyed, in such a way that the volumetric flow rate F is adjusted according to the predetermined values and the process is terminated after the volume dV to be conveyed has been reached.

Subsequently, the medium to be conveyed is sucked into the media-side chamber 17 of the diaphragm pump 14 by a volume dV to be conveyed and at a predetermined volumetric flow rate F in that control fluid is made to flow out of the control fluid-side chamber 16 of the diaphragm pump 14 to the control-fluid reservoir 2A, wherein the second proportional valve 4 is actuated by the control unit 12, as described above for determining volumetric flow rate and volume, in such a way that the volumetric flow rate is adjusted according to the predetermined values and the process is terminated after the volume dV to be conveyed has been reached.

Furthermore, it is preferable for the pressure acting on the control fluid, and thus in correlation also on the medium to be conveyed, to be monitored additionally. This has advantages not only with regard to the medium to be conveyed and the constituents thereof (such as, for example, the limitation of the shear forces acting on biological cells and the associated higher process reliability), but also for the increase in equipment safety and work safety. Here, the pressure and/or pressure gradient of the control fluid are/is limited to predefined limit values by way of the measurement of the pressure by the pressure sensor 7 and suitable interventions of the control unit 12 at the proportional valves 3, 4.

Inclusion of the pressure sensor makes it possible to achieve a volumetric control at predefined pressure and/or pressure gradient. Such a control method may preferably proceed as follows. Firstly, through regulated flowing of the control fluid into the control fluid-side chamber 16 of the diaphragm pump 14 from the control-fluid reservoir 1A, the medium to be conveyed is displaced from the media-side chamber 17 of the diaphragm pump 14 by a volume dV to be conveyed and with a predetermined pressure profile, in particular, a predetermined pressure profile over time. In this case, the first proportional valve 3 is actuated by the control unit 12, with account taken of the detected absolute pressure p of the control fluid and of the above-described method for determining the volume to be conveyed, in such a way that the control-fluid pressure p is adjusted according to the predetermined values and the process is terminated after the volume dV to be conveyed has been reached. Subsequently, through regulated flowing of the control fluid out of the control fluid-side chamber 16 of the diaphragm pump 14 to the control-fluid reservoir 2A, the medium to be conveyed is sucked into the media-side chamber 17 of the diaphragm pump 14 by a volume dV to be conveyed and with a predetermined pressure profile, in particular, a predetermined pressure profile over time. In this case, the proportional valve 4 is actuated by the control unit 12, with use made of the detected absolute pressure p and of the above-described method for determining the volume to be conveyed, in such a way that the control-fluid pressure p is adjusted according to the specifications and the process is terminated after the volume dV has been reached.

It is furthermore also possible for the volumetric end positions and intermediate reference points of the diaphragm 15 of the diaphragm pump 14 to be determined by the control arrangement 13. For this purpose, firstly a predetermined low initialization volumetric flow rate is applied to the control fluid via the proportional valve 3 and, by means of the pressure sensor 7, the temporal profile of the pressure is monitored continuously until the gradient thereof becomes significantly steeper. In this way, it can be established that the diaphragm 15 of the diaphragm pump 14 has reached one of its mechanical stops, that is to say one of its maximum positions or end positions. After this method has been carried out for the first end position through the flowing of the control fluid into the control fluid-side chamber 16 from the control-fluid reservoir 1A via the proportional valve 3, the process can be started in the opposite direction in that the control fluid flows, likewise at a predetermined initialization volumetric flow rate, out of the control fluid-side chamber 16 of the diaphragm pump 14 to the control-fluid reservoir 2A via the proportional valve 4. Here, too, the temporal profile of the pressure is at the same time monitored continuously by means of the pressure sensor 7, and the second end position is detected when the gradient increases significantly.

It is preferable that, in an accompanying manner, the total differential volume dV total is also determined according to the above-described method, said total differential volume being obtained between the two end positions of the diaphragm 15 of the diaphragm pump 14. Based on this information, definition and actuation are also possible for any intermediate reference points of the diaphragm 15, for example, the neutral position in the case of half the total differential volume dV total.

For determination of volume, as initial value, preferably the dead volume which is formed by the sum of all the volumes of the interconnected control-fluid system elements from the two proportional valves 3, 4 as far as the diaphragm pump 14 in that end position of the diaphragm pump which corresponds to a minimum volume of the control fluid-side chamber 16 is determined. Said dead volume results from the design of the control arrangement and of the control-fluid line connecting the control arrangement to the diaphragm pump and is, therefore, simple to determine. For initialization, actuation is realized for the corresponding end position of the diaphragm and the starting value of the number of particles N of the integrator is calculated on the basis of the determined dead volume and of the conditions presently measured via the pressure sensor 7 and the temperature sensor 11 with the aid of the ideal gas law or a function-based relationship matched to the control fluid used.

The control arrangement described herein and the method for controlling a sensor-free diaphragm pump have a large number of advantages in comparison with existing solutions. Existing solutions, which rely, in particular, on a distance sensor for detecting the position of the diaphragm of a diaphragm pump, are in principle associated with greater tolerances, since here, the displaced volume is determined only indirectly and the spatial deformation of the elastic diaphragm cannot be described in a reproducible manner. Furthermore, the distance sensor for detecting the position of the diaphragm leads to an increase in the cost of the diaphragm pump. Additionally, the handling effort by the user is increased, and a system structure with only a low level of integration is achieved. The control arrangement described herein and the method for controlling a sensor-free diaphragm pump, by contrast, allow a positional control of the diaphragm on the basis of a volumetric determination and avoid the arrangement of sensor components in the direct vicinity of the diaphragm pump. In this way, a real, or volumetric, determination of the fluid volume moved can be realized instead of merely a spacing measurement of the diaphragm with non-reproducible deformation behavior. At the same time, a high level of integration is achieved since all the sensors required for the control can be accommodated in the control system (wherein possibly a temperature sensor can be connected via a temperature-sensor interface too). The diaphragm pump to be actuated is, by contrast, sensor-free. This results in a simple structure and better handling by the user since a sensor is not contained in the diaphragm pump and, accordingly, an associated connecting cable and a corresponding connection outlay between a sensor of the diaphragm pump and the control arrangement are dispensed with too. The control described herein furthermore makes it possible for the constituents of the medium to be conveyed, such as, for example, biological cells, to be loaded only to a small extent or for this loading to be controlled. Altogether, it is thus possible to achieve a significant improvement in the actuation of diaphragm pumps, in particular, in application areas of disposable bioreactors in bioprocesses.

The invention claimed is:

1. A control arrangement for controlling a sensor-free diaphragm pump, the control arrangement comprising:

a control-fluid inlet for connection to a first control-fluid reservoir having a pressure level which is elevated in relation to a reference pressure;

a control-fluid outlet for connection to a second control-fluid reservoir having a pressure level which is reduced in relation to a reference pressure;

a control-fluid connection for connection to a control-fluid line for the sensor-free diaphragm pump, wherein the control-fluid inlet is connected via a first proportional valve to a collecting point, and the control-fluid outlet is connected via a second proportional valve to the collecting point, and wherein a mass flow sensor is arranged between the collecting point and the control-fluid connection; and a control unit in signal communication with the first proportional valve, the second proportional valve, and the mass flow sensor, wherein the control unit is configured to control a control fluid flow based on data detected by the mass flow sensor, wherein for controlling the control fluid flow based on the data detected by the mass flow sensor the control unit is adapted to actuate the first proportional valve of the control arrangement for enabling throughflow, and conveying a first volume of a control fluid, close the first proportional valve when the first volume of a control fluid to be conveyed has been reached, actuate the second proportional valve for enabling throughflow, and conveying a second volume of a control fluid, and close the second proportional valve when the second volume of a control fluid to be conveyed has been reached, wherein the control unit is further configured to determine the volumes to be conveyed of the control fluid, wherein determining the volumes to be conveyed comprises:

detecting a mass flow rate of the control fluid based on the data detected by the mass flow sensor, deducing a volumetric flow rate from the mass flow rate, and deducing a volume of the conveyed control fluid from the volumetric flow rate.

2. The control arrangement as claimed in claim 1, further comprising:

a pressure sensor arranged between the collecting point and the control-fluid connection.

3. The control arrangement as claimed in claim 2, wherein the pressure sensor is an absolute pressure sensor.

4. The control arrangement as claimed in claim 3, further comprising a temperature sensor and a temperature sensor interface for signal exchange with the temperature sensor for receiving data from the temperature sensor.

5. The control arrangement as claimed in claim 4, wherein the control unit is signal-connected to the pressure sensor and to the temperature sensor and to the temperature sensor interface.

6. The control arrangement as claimed in claim 1, wherein the control unit has a communication interface for data exchange with an external communication unit.

7. A diaphragm pump arrangement having a sensor-free diaphragm pump and having the control arrangement as claimed in claim 1.

8. A bioreactor having the diaphragm pump arrangement as claimed in claim 7.

9. A bioreactor, the bioreactor comprising the diaphragm pump arrangement as claimed in claim 7 and a pressure sensor arranged between the collecting point and the control-fluid connection.

10. A diaphragm pump for use with the control arrangement as claimed in claim 1, wherein the diaphragm pump is free of a distance sensor for detecting a position of a diaphragm of the diaphragm pump.

11. A bioreactor having the diaphragm pump as claimed in claim 10.

12. A bioreactor, the bioreactor comprising the diaphragm pump as claimed in claim 10 and a pressure sensor arranged between the collecting point and the control-fluid connection.

13. A method for controlling a diaphragm pump with the control arrangement as claimed in claim 1, the method comprising the steps of: actuating the first proportional valve of the control arrangement for enabling throughflow, and conveying the control fluid; closing the first proportional valve when the first volume to be conveyed has been reached; actuating the second proportional valve for enabling throughflow, and conveying the control fluid; and closing the second proportional valve when the second volume to be conveyed has been reached.

14. The method as claimed in claim 13, further comprising the step of determining the volume to be conveyed of the control fluid.

15. The method as claimed in claim 14, wherein determining the volume to be conveyed of the control fluid comprises the steps of:

detecting the mass flow rate of the control fluid;

deducing the volumetric flow rate from the mass flow rate; and deducing the volume of the conveyed control fluid from the volumetric flow rate.

16. The method as claimed in claim 13, further comprising the steps of:

detecting a pressure of the control fluid; and actuating the first or the second proportional valve in such a way that a predefined target pressure of the control fluid is not exceeded or a predefined target-pressure range is complied with or a predefined pressure gradient is complied with.

17. The method as claimed in claim 13, comprising the step of determining end positions of a diaphragm of the sensor-free diaphragm pump.

18. The method as claimed in claim 17, wherein determining the end positions of the diaphragm of the sensor-free diaphragm pump comprises the steps of:

conveying the control fluid at a predefined initialization volumetric flow rate;

detecting a pressure gradient of the control fluid; and establishing a presence of an end position of the diaphragm when the pressure gradient changes.

* * * * *